US005853044A

United States Patent [19]

Wheaton et al.

[11] Patent Number: 5,853,044

[45] Date of Patent: Dec. 29, 1998

[54] METHOD OF CASTING AN ARTICLE

[75] Inventors: Harold L. Wheaton, Bowerston; Lawrence D. Graham, Chagrin Falls, both of Ohio

[73] Assignee: PCC Airfoils, Inc., Cleveland, Ohio

[21] Appl. No.: 636,926

[22] Filed: Apr. 24, 1996

[51] Int. Cl.[6] ..... B22C 7/02; B22C 9/04

[52] U.S. Cl. ..... 164/516; 164/30; 164/31; 164/34; 164/35; 164/45

[58] Field of Search ..... 164/516, 30, 31, 164/34, 35, 36, 45

[56] References Cited

U.S. PATENT DOCUMENTS

| | | | |
|---|---|---|---|
| 3,596,703 | 8/1971 | Bishop et al. | 164/30 X |
| 4,289,191 | 9/1981 | Myllymaki | 164/34 X |
| 4,384,607 | 5/1983 | Wood et al. | 164/35 X |
| 4,421,153 | 12/1983 | Wilkinson et al. | 164/516 X |
| 4,434,835 | 3/1984 | Willgoose | 164/516 X |
| 5,295,530 | 3/1994 | O'Connor et al. . | |
| 5,296,308 | 3/1994 | Caccavale et al. | 164/516 X |

*Primary Examiner*—J. Reed Batten, Jr.
*Attorney, Agent, or Firm*—Tarolli, Sundheim, Covell, Tummino & Szabo

[57] ABSTRACT

A wax article pattern having a cavity corresponding to a cavity in a metal article is provided. The cavity in the wax article pattern is filled with a slurry of ceramic core material. The slurry of ceramic core material is solidified to form a core. The wax article pattern is enclosed by ceramic mold material. The ceramic mold material is solidified to form a mold. The wax pattern is removed from the mold to leave an article mold cavity. The article mold cavity is filled with molten metal which is solidified to form the metal article. A passage in the metal article may be formed by a pin which extends from the wax article pattern into the cavity in the wax article pattern and is enclosed by the slurry of ceramic core material.

16 Claims, 6 Drawing Sheets

METHOD OF CASTING AN ARTICLE

BACKGROUND OF THE INVENTION

The present invention relates to an improved method of casting a metal article and more specifically to a method of casting a metal article having a cavity.

Cores are commonly provided in molds in which metal articles are cast. The cores form cavities and/or passages in the cast metal article. The manner in which a core is used with a mold to form a cavity in a metal article is disclosed in U.S. Pat. No. 4,596,281 issued Jun. 24, 1986 and entitled "Mold Core and Method of Forming Internal Passages in an Airfoil".

A mold having cores to form cavities and passages in a cast metal article is disclosed in U.S. Pat. No. 5,295,530 issued Mar. 22, 1994 and entitled "Single-Cast High-Temperature, Thin Wall Structures and Methods of Making the Same". The mold disclosed in the aforementioned U.S. Pat. No. 5,295,530 is fabricated by drilling holes in a main core and in an outer core to allow quartz or alumina pins to be inserted into the cores. Since the size of the holes is very small, about 0.015 to 0.020 inches, drilling the holes is difficult and time consuming. Further, core breakage can occur during the drilling process.

SUMMARY OF THE INVENTION

The present invention provides a new and improved method of casting a metal article having a cavity formed therein. To form the metal article, a wax article pattern having a configuration corresponding to the configuration of the metal article is formed. A flow of a ceramic core material is conducted into a cavity in the wax article pattern to at least partially fill the cavity. An outer side of the wax article pattern is at least partially enclosed with ceramic mold material. The ceramic core material is solidified to form a core in the cavity in the wax article pattern. The ceramic mold material is solidified to form a mold which at least partially encloses the wax article pattern.

The wax article pattern is then removed to leave an article mold cavity. Molten metal is conducted into the article mold cavity and is solidified to form the metal article. The cavity in the metal article is at least partially defined by the ceramic core. An outer side of the metal article is at least partially defined by the ceramic mold.

If passages beyond those provided by the poured ceramic core material are to be provided in the cast article, one or more quartz or alumina pins may be provided in association with the wax article pattern. A portion of a pin is enclosed by the wax article pattern. Another portion of the pin projects into the cavity in the wax article pattern.

When the ceramic core material is conducted into the cavity in the wax article pattern, the core material encloses the portion of the pin which is disposed in the cavity. When the core material is solidified to form a core, a portion of the pin is held by the core. When the wax article pattern is removed to leave an article mold cavity, a portion of the pin is disposed in the article mold cavity. Therefore, when molten metal is conducted in to the article mold cavity, the molten metal encloses the portion of the pin in the article mold cavity. Subsequent removal of the pin from the cast metal article results in the formation of a passage in the metal article.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

Method of Casting a Metal Article

Figure 1:
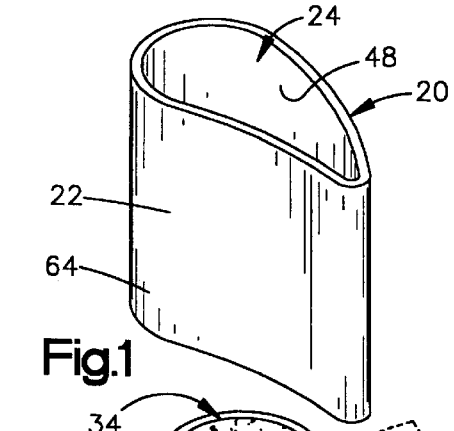
FIG. 1 is a simplified schematic illustration of a cast metal article having a cavity.

A cast metal article 20 is illustrated in FIG. 1. The cast metal article 20 has a thin side wall 22 which at least partially defines an article cavity 24. Although the cast metal article 20 could have many different configurations, the cast metal article may have a configuration corresponding to the configuration of any one of many different known airfoils.

The illustrated embodiment of the cast metal article 20 is formed of a nickel-chrome superalloy. However, it is contemplated that the cast metal article 20 could be formed of many different metals. For example, the cast metal article 20 could be formed of titanium or other reactive metals.

Figure 2:
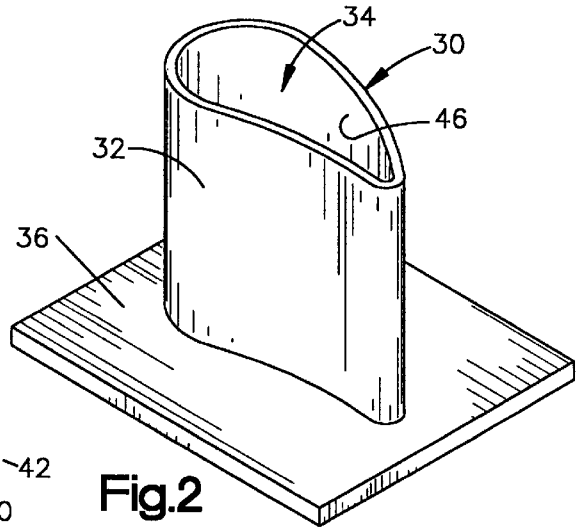
FIG. 2 is a schematic illustration of a wax article pattern having a configuration corresponding to the configuration of the cast metal article of FIG. 1 and having a cavity corresponding to the cavity in the cast metal article of FIG. 1.

In order to cast the metal article 20, an article pattern 30 (FIG. 2) is formed. The article pattern 30 may be formed of a natural or synthetic wax or other material. The article pattern 30 has a thin side wall 32 with a configuration which corresponds to the configuration of the thin side wall 22 of the cast metal article 20. In addition, the article pattern 30 has a pattern cavity 34 with a configuration which corresponds to the configuration of the article cavity 24 in the cast metal article 20. The thin side wall 22 of the article pattern 30 is supported on a rectangular base 36 which facilitates handling of the article pattern 30.

In accordance with one of the features of the present invention, the article pattern 30 is used as a mold to cast a core which forms the article cavity 24 in the cast metal article 20. To form a core to the shape of the article cavity 24 in the cast metal article 20 (FIG. 1), a wet slurry of ceramic core material 40 is conducted into the pattern cavity 34 in the article pattern 30 in the manner indicated schematically by the arrow 42 in FIG. 3. The pattern cavity 34 in the article pattern 30 is used as a mold cavity in which the slurry of ceramic core material 40 is cast to a desired configuration corresponding to the configuration of the article cavity 24 in the metal article 20.

The ceramic core material 40 may be a slurry which contains fused silica, zircon and other refractory materials in combination with binders. Chemical binders such as ethylsilicate, sodium silicate and colloidal silica can be used. In addition, the slurry may contain suitable film formers such alginates to control viscosity and wetting agents to control flow characteristics and pattern wettability. The slurry may have either a water or nonwater base.

The slurry of core material may use a binder which includes a water soluble component and water insoluble component. The water soluble component of the binder may be polyethylene glycol and the water insoluble component may be a polyacetal copolymer. The liquid heterogeneous mixture of water soluble and water insoluble components of the binder are mixed with a ceramic powder. The ceramic powder may contain yttrium aluminate and alumina. In this specific instance, the slurry of ceramic core material 40 has the same composition and be formed in the same manner as is disclosed in U.S. Pat. No. 5,409,871 issued Apr. 25, 1995 and entitled "Ceramic Material for Use in Casting Reactive Metals".

Alternatively, it is contemplated that the ceramic core material 40 could be an aqueous slurry which contains water, a binder, a source of hydroxyl ions and yttria. This specific core material slurry may have the composition disclosed in U.S. Pat. No. 4,947,927 issued Aug. 14, 1990 and entitled "Method of Casting a Reactive Metal Against a Surface Formed From an Improved Slurry Containing Yttria". Although the aforementioned U.S. Pat. No. 4,947,927 discloses an aqueous slurry of ceramic core material, it is contemplated that a nonaqueous core material slurry could be utilized if desired.

The foregoing specific core materials have been set forth herein for purposes of clarity of description. It is contemplated that any one of many different core materials may be used if desired. Although ceramic core materials are preferred, other core materials may be used if desired.

Figure 3:
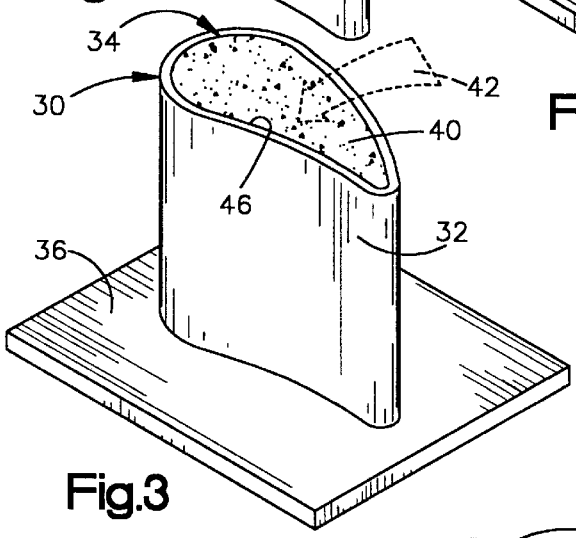
FIG. 3 is a schematic illustration depicting the manner in which the cavity in the wax article pattern of FIG. 2 is filled with a slurry of ceramic core material.

As the wet slurry of ceramic core material 40 is conducted into the pattern cavity 34 in the wax article pattern 30, in the manner indicated by the arrow 42 in FIG. 3, the slurry of ceramic core material engages an inner side surface 46 of the pattern cavity. The slurry of ceramic core material in the article pattern 30 is shaped to a configuration which corresponds to the configuration of the inner side surface 46 of the pattern cavity 34 in the wax article pattern. The inner side surface 46 of the cavity 34 in the article pattern 30 has the same configuration as the configuration of an inner side surface 48 (FIG. 1) of the article cavity 24 in the cast metal article 20. Therefore, the ceramic core material 40 is molded to a configuration which corresponds to the configuration of the inner side surface 48 of the cast metal article 20 by engagement of the slurry with the inner side surface 46 of the article pattern 30.

Once the pattern cavity 34 (FIG. 3) in the article pattern 30 has been filled with the wet slurry of ceramic core material 40, the core material is at least partially dried. As the ceramic core material is dried, it is solidified to form a core having a size and configuration which corresponds to the size and configuration of the article cavity 24 in the cast metal article 20. Thus, the article pattern 30 functions as a mold for the ceramic core material 40.

After the slurry of ceramic core material 40 has been at least partially dried, the article pattern 30 is enclosed by a wet covering 52 of ceramic mold material. The wet covering 52 of ceramic mold material may be applied to the article pattern 30 by dipping the article pattern in a slurry of ceramic mold material. Although many different types of slurries of ceramic mold material could be utilized, one illustrative slurry contained fused silica, zircon and other refractory materials in combination with binders. Chemical binders such as ethylsilicate, sodium silicate and colloidal silica can be utilized. In addition, the slurry may contain suitable film formers, such as alginates, to control viscosity and wetting agents to control flow characteristics and pattern wettability.

In accordance with common practices, an initial slurry coating applied to the wax article pattern 30 may contain a finely divided refractory material to produce an accurate finish. A typical slurry for a first coat may contain approximately 29% colloidal silica suspension in the form of a 20% to 30% concentrate. Fused silica of a particle size of 325 mesh or smaller in an amount of 71% can be employed together with less than 1% to 10% by weight of a wetting agent. Generally, the specific gravity of the ceramic mold material may be on the order of 1.75 to 1.80 and may have a viscosity of 40 to 60 seconds when measured with a Number 5 Zahn Cup at 75° to 85° F. After the application of the initial coating, the surface may be stuccoed with refractory materials having particle sizes on the order of 60 to 200 mesh.

Although one specific type of ceramic mold material has been described, other known types of ceramic mold materials could be utilized if desired. For example, the ceramic mold material used to form the wet covering 52 could be formed by mixing an aqueous based binder with yttria and a source of hydroxyl ions. The slurry could also contain other additives. This slurry could be constructed in the manner and have the same composition as the slurry disclosed in the aforementioned U.S. Pat. No. 4,947,927.

It is contemplated that the core material 40 and mold material 52 could have the same composition if desired. However, it is contemplated that it may be preferred to form the core material 40 with one composition and the mold material 52 with a different composition. It is believed that, for many core and mold designs, it may be preferred to form the core and mold from materials having similar coefficients of expansion.

Figure 4:
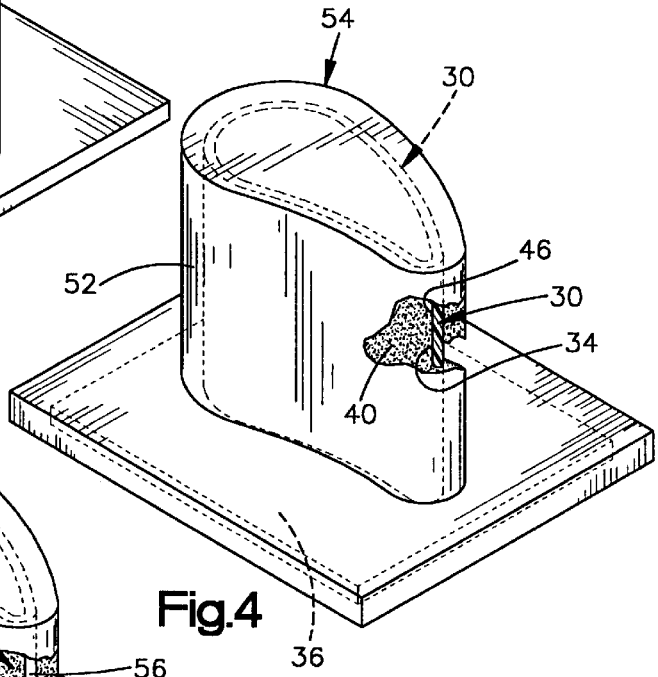
FIG. 4 is a partially broken away schematic illustration of the wax pattern of FIG. 3 enclosed by ceramic mold material after the cavity in the pattern has been filled with ceramic core material.

After the wet covering 52 of ceramic mold material has been applied over the outside of the wax article pattern 30, the wet covering of ceramic mold material is at least partially dried. This results in the formation of an article mold 54 (FIG. 4).

The article mold 54 is heated to melt the wax article pattern 30. The melted wax is poured out of the mold 54 through an open end of a pour cup (not shown) connected with the mold. This results in the formation of an article mold cavity 56 which is disposed between the article mold 54 and a core 58 formed by the ceramic core material 40. The article mold cavity 56 has a configuration which is the same as the configuration of the wax article pattern 30. Therefore, the configuration of the article mold cavity 56 corresponds to the configuration of the cast metal article 20 (FIG. 1).

Figure 5:
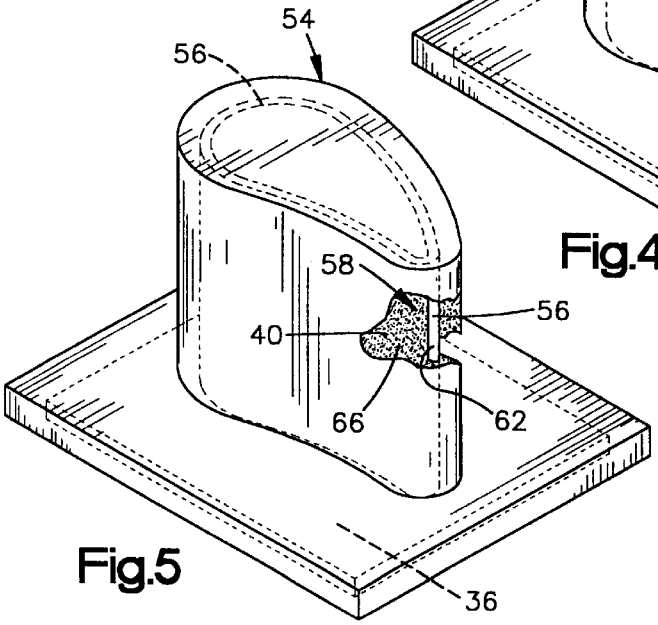
FIG. 5 is a partially broken away schematic illustration, generally similar to FIG. 4, illustrating an article mold cavity formed upon removal of the wax article pattern.

The article mold 54 and core 58 are then fired at a temperature of approximately 1,900° F. for a time sufficient to cure both the article mold and the core. This results in the formation of a rigid ceramic mold 54 having an inner side surface 62 (FIG. 5) with a configuration corresponding to the configuration of an outer side surface 64 (FIG. 1) on the thin side wall 22 of the cast metal article 20. The rigid ceramic core 58 has an outer side surface 66 with a configuration which corresponds to the configuration of the inner side surface 48 (FIG. 1) on the cast metal article 20.

Once the article mold 54 and core 58 (FIG. 5) have been formed in the manner previously described, a flow of molten metal is conducted into the article mold cavity 56. The molten metal fills the article mold cavity 56. The molten metal is solidified to form the cast metal article 20.

The outer side surface 64 (FIG. 1) of the cast metal article 20 is formed by solidifying the molten metal against the inner side surface 62 (FIG. 5) of the article mold 54. The inner side surface 48 of the article cavity 24 in the cast metal article 20 is formed by solidifying the molten metal against the outer side surface 66 of the core 58. Since the outer side surface 66 of the core 58 was accurately molded in the pattern cavity 34 (FIGS. 2 and 3) in the wax article pattern 30, the inner side surface 48 of the cavity 24 (FIG. 1) in the cast metal article 20 is accurately formed. Since the mold 54 (FIG. 5) is formed around the outer side surface of the side wall 32 of the wax article pattern 30 while the core 58 is disposed within the wax article pattern, the thin side wall 22 of the cast metal article is accurately formed to have a desired thickness throughout its extent.

Although a relatively simple cast metal article 20 has been illustrated schematically in FIG. 1, it is contemplated that the method of the present invention could be used to form complicated cast metal articles. Thus, the method of the present invention could be used to form complicated airfoils used in turbine engines. Although the cast metal article 20 has a thin side wall 22, the method of the present invention could be used to form articles having thick side walls or articles having thick and thin side walls.

In view of the foregoing description, it is apparent that the present invention provides a new and improved method of casting a metal article 20 having a cavity 24 formed therein. To form the metal article 20, a wax article pattern 30 (FIG. 2) having a configuration corresponding to the configuration of the metal article 20 is formed. A flow 42 (FIG. 3) of a ceramic core material 40 is conducted into the cavity 34 in the wax article pattern 30 to at least partially fill the cavity. The outer side 32 of the wax article pattern 30 is at least partially enclosed with ceramic mold material 52 (FIG. 4). The ceramic core material 40 is solidified to form a core 58 (FIG. 5) in the cavity 34 in the wax article pattern 30. The ceramic mold material 52 is solidified to form a mold 54 which at least partially encloses the wax article pattern 30.

The wax article pattern 30 is then removed to leave an article mold cavity 56. Molten metal is conducted into the article mold cavity and is solidified to form the metal article 20. The cavity 24 in the metal article 20 is at least partially defined by the ceramic core 58 and the outer side of the metal article is at least partially defined by the ceramic mold 54.

Second Embodiment—Metal Article

Figure 6:
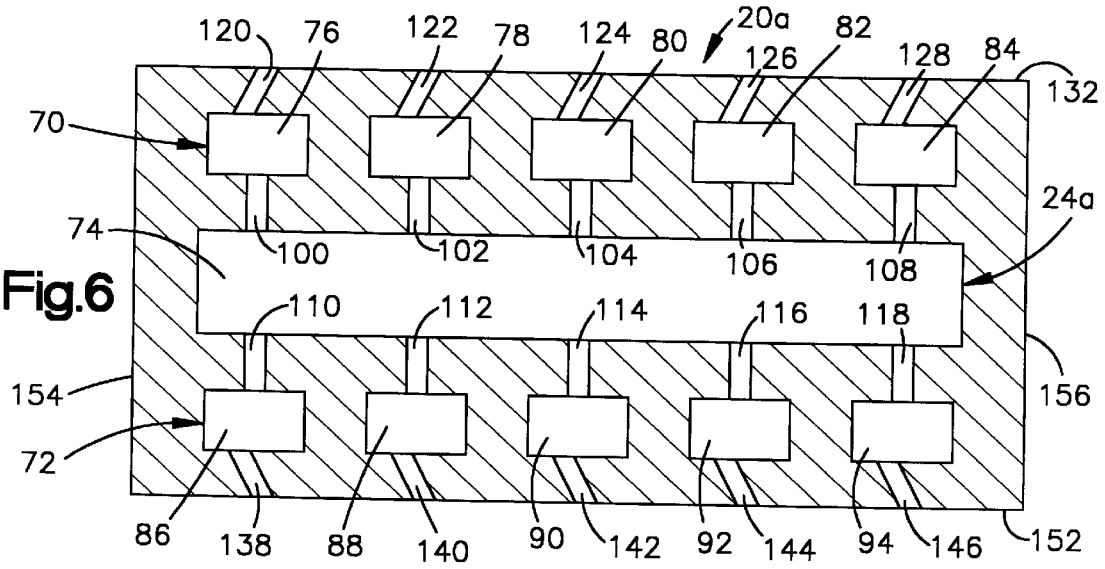
FIG. 6 is a simplified schematic illustration of a second metal article which may be cast using the method of the present invention.

The embodiment of the cast metal article illustrated in FIGS. 1–5 has a single cavity 24. In the embodiment of the cast metal article illustrated in FIGS. 6–13, the cast metal article has a plurality of cavities and a plurality of passages. The cast metal article illustrated in FIG. 6 is a highly schematicized representation of a blade for a turbine engine. Since the embodiment of the cast metal article illustrated in FIG. 6 is generally similar to the embodiment of the cast metal article illustrated in FIG. 1, similar numerals will be utilized to designate similar components, the suffix letter "a" being associated with the numerals of FIGS. 6–13 to avoid confusion.

A simplified cast metal article 20*a* (FIG. 6) includes a plurality of cavities 24*a*. The cavities 24*a* include a first linear array 70 of cavities, a second linear array 72 of cavities, and a relatively large main cavity 74. The first linear array 70 of cavities includes long slender rectangular cavities 76, 78, 80, 82, and 84 having parallel central axes. All of the cavities in the first linear array 70 of cavities have the same long slender rectangular configuration and size. However, if desired, cavities having different sizes and/or configurations could be provided in the first linear array 70 of cavities.

The second linear array 72 of cavities includes long slender, cavities 86, 88, 90, 92, and 94 having parallel central axes. The cavities in the second linear array 72 of cavities are of the same size and have the same configuration as the cavities in the first linear array 70. However, it is contemplated that the cavities in the second linear array 72 of cavities could have different sizes and/or configurations if desired. In addition, it is contemplated that the cavities in the arrays 70 and 72 of cavities need not be straight and parallel and could have turbulators for improved cooling.

The relatively large main cavity 74 has a rectangular configuration and is as long as the cavities in the first and second arrays 70 and 72 of cavities. The main cavity 74 has a longitudinal central axis which extends parallel to the central axis of the cavities in the first and second arrays 70 and 72 of cavities. The main cavity 74 and the first and second arrays 70 and 72 of cavities extend between opposite ends of the cast metal article 20*a*. However, it is contemplated that one end of the main cavity 74 and one of the ends of each cavity in the first and second arrays of cavities will be blocked during use of the cast metal article 20. The other end of each cavity in the first and second arrays of cavities may be connected with the main cavity 74.

The relatively large main cavity 74 (FIG. 6) is connected with the first linear array 70 of cavities by passages 100, 102, 104, 106, and 108 formed in the cast metal article 20*a*. Similarly, passages 110, 112, 114, 116, and 118 connect the main cavity 74 with the cavities in the second linear array 72 of cavities.

Passages 120, 122, 124, 126, and 128 (FIG. 6) extend from the cavities 76–84 in the first linear array 70 of cavities to an outer side surface 132 of the cast metal article 20*a*.

Similarly, passages 138, 140, 142, 144 and 146 extend from the cavities 86–94 in the second linear array 72 of cavities to an outer side surface 152 of the cast metal article 20*a*.

Although only a single passage 100 has been shown in FIG. 6 as extending between the main cavity 74 and the cavity 76, a linear array of passages extends between the main cavity and the cavity 76. Similarly, although only a single passage 120 has been shown in FIG. 6, a linear array of passages extends between the cavity 76 and the outer side surface 132. Similarly, the passages 102–118, 122–128 and 138–146 are each but one passage in a linear array of passages.

In the illustrated simplified schematic embodiment of the cast metal article 20*a*, the side surfaces 132 and 152 are flat rectangular surfaces which extend parallel to each other. The surfaces 132 and 152 are interconnected by parallel flat rectangular end surfaces 154 and 156.

It should be understood that the cast metal article 20*a* could have a configuration which is substantially different from the greatly simplified configuration illustrated schematically in FIG. 6. For example, the cast metal article 20*a* could be an airfoil having a main cavity corresponding to the cavity 74 and a plurality of long slender cavities with turbulators which are connected with the main cavity and outer side surfaces of the airfoil by passages corresponding to the passages 120–128 and 138–146. Of course, the cast metal article 20*a* could be an article which is substantially different than an airfoil if desired.

The cast metal article 20*a* illustrated in FIG. 6 is a highly schematicized representation of a blade which is used in a turbine engine. The cavities 74–94 are a simplified schematic representation of a turbine airfoil cooling scheme. Cooling air is introduced into the main cavity 74 and flows into the cavities 76–94 through the passages 100–118. The passages 100–118 are sometimes referred to as resupply holes.

As the air flows along the cavities 76–94 it is turbulated and cools the airfoil. Some of the cooling air is conducted through the passages 120–128 and 138–146 to cool outer side surfaces of the airfoil. The passages 120–128 and 138–146 may be referred to as film cooling holes.

The cast metal article 20*a* could have any desired configuration and could be formed of any desired metal. In the specific embodiment of the cast metal article 20*a* illustrated in FIG. 6, the cast metal article is formed of a nickel-chrome superalloy. However, the cast metal article 20*a* could be formed of titanium or other metals if desired.

Pattern Assembly For Use in Making a Core

When the cast metal article 20*a* is to be formed, a pattern assembly 162 (FIG. 7) for use in making a mold core is constructed. The core pattern assembly 162 includes a main core pattern member 166. The main core pattern member 166 is connected with a first linear array 168 of secondary core pattern members and a second linear array 170 of secondary core pattern members. It should be understood that the core pattern assembly 162 is not a core. The core pattern assembly 162 is only a pattern having a configuration corresponding to the desired configuration of a core.

The first linear array 168 of secondary core pattern members includes long slender rectangular secondary core pattern members 174, 176, 178, 180, and 182. Similarly, the second linear array 170 of secondary core pattern members include long slender rectangular secondary core pattern members 184, 186, 188, 190, and 192. The secondary core pattern members 174–192 all have the same long, thin, rectangular configuration. However, it is contemplated that the secondary core members 174–192 could have a configuration which is different from the illustrated configuration and could have configurations which are different from each other. It should be understood that the main core pattern member 166 and the secondary core pattern members 174–192 are not part of a core. The main core pattern member 166 and secondary core pattern members 174–192 are merely pattern members having configurations corresponding to portions of a core.

Figure 7:
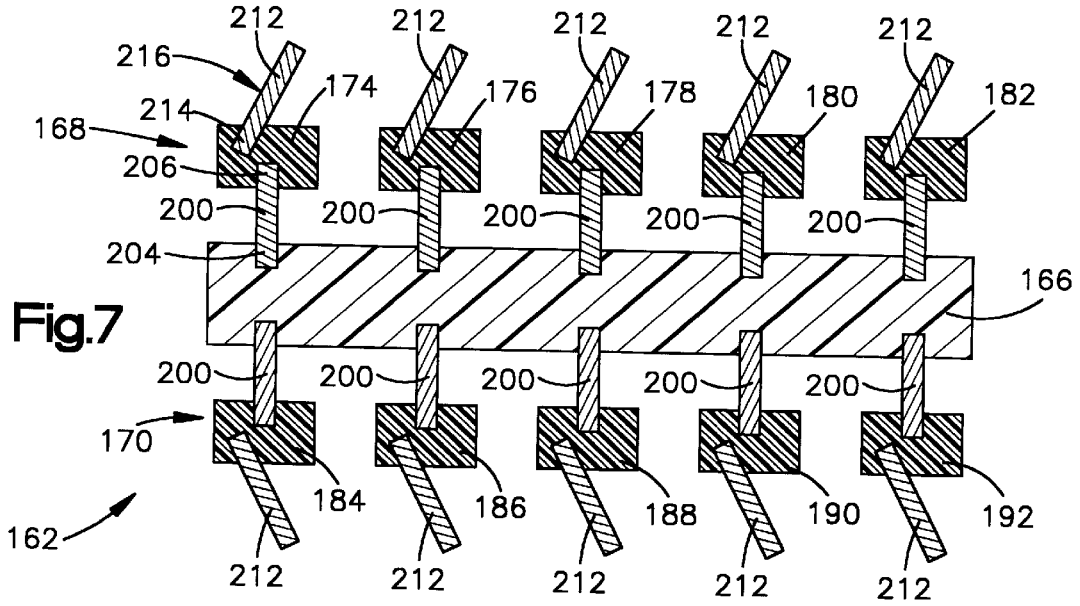
FIG. 7 is a schematic illustration of a pattern assembly for use in making a core, the pattern assembly has pattern members with configurations corresponding to configurations of cavities in the cast metal article of FIG. 6.

The configuration of the secondary core pattern members 174–182 in the first linear array 168 of secondary core pattern members corresponds to the configuration of the cavities 76–84 in the first linear array 70 of cavities. Similarly, the secondary core pattern members 184–192 in the second linear array 70 of secondary core pattern members have configurations which correspond to the configurations of the cavities 86–94 in the second linear array 72 of cavities in the cast metal article 20*a* (FIGS. 6 and 7). The main core pattern member 166 has a long, rectangular configuration which corresponds to the long, rectangular configuration of the main cavity 74 in the cast metal article 20*a*.

The secondary core pattern members 174–192 are connected with the main core pattern member 166 by identical cylindrical pins 200 (FIG. 7). Thus, one of the cylindrical pins 200 has an end portion 204 (FIG. 7) which is embedded in the main core pattern member 166. An opposite end portion 206 of the pin 200 is embedded in the secondary core pattern member 174. A portion of the pin 200 extends between the main core pattern member 166 and the secondary core pattern member 174 to hold the secondary core pattern member 174 in a spaced apart relationship with the main core pattern member 166.

The pins 200 may be formed of fused quartz or alumina. The pins 200 will eventually become part of a core disposed within an article mold. The pins 200 form the passages 100–118 (FIG. 6) when the article 20*a* is cast.

Each of the secondary core pattern members 174–192 (FIG. 7) is spaced the same distance from the main core pattern member 166 by the identical pins 200. However, it should be understood, that the pins 200 could have different lengths and/or different diameters. It should also be understood that the spacing between the pins 200 could vary.

Although only a single pin 200 has been shown in FIG. 7 as connecting one of the secondary core pattern members 174–192 with the main core pattern member 166, there are a plurality of pins 200 connecting each of the long thin secondary core pattern members 174–192 with the relatively large main core pattern member 166. Thus, a linear array of parallel pins 200 extends axially along each of the long slender secondary core pattern members 174–192.

The spacing and location of the pins 200 which interconnect the secondary core pattern members 174–192 and the main core pattern member 166 is the same as the spacing and location of the passages 100–118 (FIG. 6) which interconnect the main cavity 74 and the secondary cavities 76–94. Of course, if it was desired to provide the passages interconnecting the main cavity 74 and the secondary cavities 76–94 with a different configuration, the pins 200 (FIG. 7) would have a different configuration corresponding to the desired configuration of the passages. The number of pins provided between the main core pattern member 166 and the secondary core pattern members 174–192 is the same as the number of passages which are desired between the main cavity 74 (FIG. 6) and the secondary cavities 76–94 in the cast metal article 20*a*.

A plurality of pins 212 (FIG. 7) extend outward from the secondary core pattern members 174–192. Each of the pins 212 has an end portion which is embedded in the material of one of the secondary core pattern members 174–192 to support the pins. Thus, the pin 212 extending from the secondary core pattern member 174 has an end portion 214 which is embedded in the material of the secondary core pattern member. An outer end portion 216 of the pin 212 is free or unrestrained.

In the illustrated embodiment of the core pattern assembly 162 (FIG. 7), the pins 212 are the same size and have the same cylindrical configuration as the pins 200. This is because the passages 120–128 and 138–146 in the cast metal article 20*a* (FIG. 6) have the same diameter and configuration as the passages 100–118 in the cast metal article 20*a*. However, if it was desired to provide the passages 120–128 and 138–146 in the cast metal article 20*a* with a different size and/or configuration than the passages 100–118, the pins 212 would have a size and configuration which differs from the size and configuration of the pins 200.

Although all of the pins 212 have the same size and configuration, it is contemplated that different pins could have a different size, spacing and/or configuration if it was desired to provide passages 120–128 and 138–146 in the cast metal article 20*a* with different sizes, spacing and/or different configurations. Thus, the size and configuration of the pins 212 correspond to the size and configuration of the passages 120–128 and 138–146 in the cast metal article 20*a*. Although only a single pin 212 has been shown in FIG. 7 as being connected with each of the secondary core pattern members 174–192, a plurality of pins 212 are associated with each of the core pattern members 174–192. Thus, a linear array of parallel pins 212 extends axially along each of the long slender secondary core pattern members 174–192. The number and location of the pins 212 connected with each of the secondary core pattern members 174–192 corresponds to the number and location of the passages 120–128 and 138–146 associated with the secondary cavities 76–94.

Article Pattern

The core pattern assembly 162 is used in the making of a wax article pattern having a configuration corresponding to the configuration of the cast metal article 20*a* of FIG. 6. It should be understood that a core has not yet been formed. The core pattern assembly 162 is not a core. The core pattern assembly 162 merely has a configuration corresponding to the configuration of a core which is to be formed.

Figure 8:
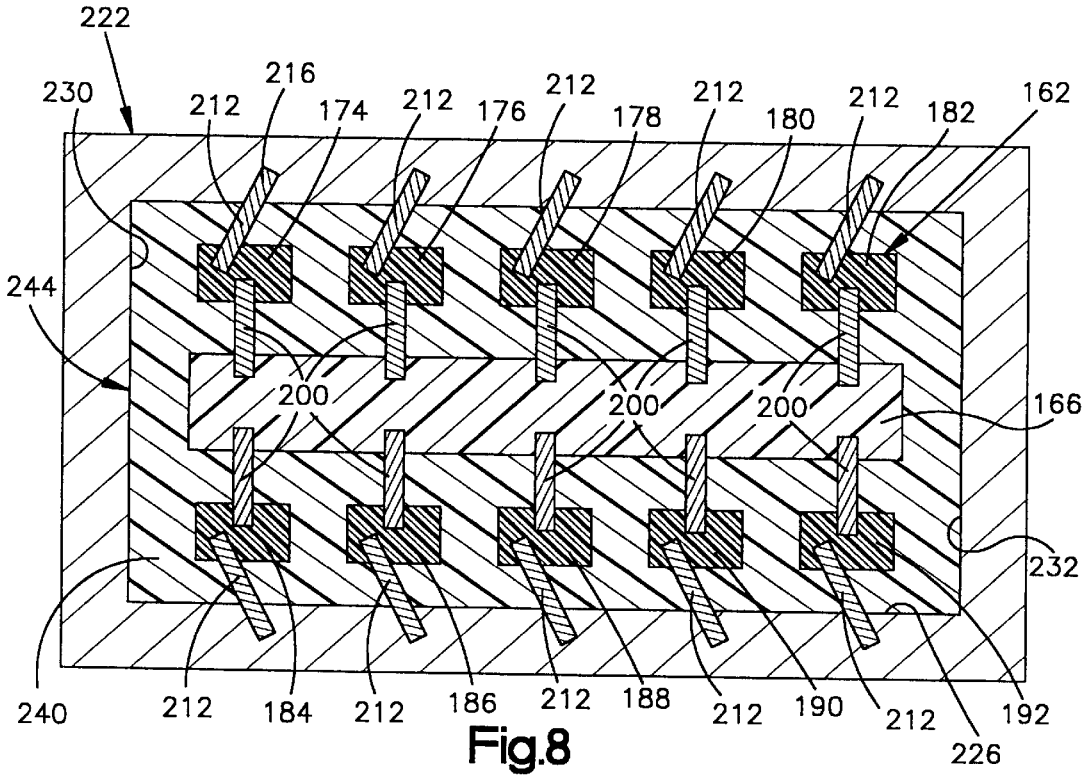
FIG. 8 is a schematic illustration depicting the manner in which the pattern assembly of FIG. 7 for making a core, is enclosed by wax pattern material to form a wax article pattern.

To provide a wax pattern having a size and configuration corresponding to the size and configuration of the cast metal article 20*a* (FIG. 6), the core pattern assembly 162 (FIG. 7) is enclosed in an injection die 222 (FIG. 8). The die 222 has flat parallel rectangular inner side surfaces 224 and 226 of a size and configuration which corresponds to a size and configuration of the outer side surfaces 132 and 152 (FIG. 6) on the cast metal article 20*a*. Similarly, the die 222 has flat parallel rectangular end surfaces 230 and 232 which extend between the side surfaces 224 and 226 and have a size and configuration corresponding to the size and configuration of the end surfaces 154 and 156 on the cast metal article 20*a*. Suitable end walls (not shown) are provided at opposite ends of the die 222.

The free end portions, that is the end portions 216 (FIG. 7), of the pins 212 are received in openings formed in the side walls of the die 222. Although the die 222 has been illustrated schematically in FIG. 8 as being constructed from a single piece of metal, it is contemplated that the die 222 may be constructed of a plurality of pieces of metal to facilitate assembling the die around the core pattern assembly 162. It should be understood that the pattern assembly 162 is completely enclosed by the die 222 which has end walls (not shown) which interconnect the side and end walls shown in FIG. 8.

It should be recognized that the tooling to accommodate all of the pins 212 may not be economically practical. An alternate approach is to prepare the wax pattern without the pins 212 and then drill the pattern and insert the pins. This can be done with the core pattern in place or after it has been removed to form the cavity which will form the core. Another approach is to leave these pins out altogether in which case the film cooling holes would be drilled in the final casting. A still further approach is to inject only a portion of the pins which allows for core support without prohibitively expensive tooling. The choice of the approach is largely economic and will vary with design.

Once the core pattern assembly 162 has been completely enclosed by the die 222 (FIG. 8), molten wax article pattern material 240 is injected into the die around the core pattern assembly 162. The hot liquid wax article pattern material 240 flows around the main core pattern member 166 and the secondary core pattern members 174–192. The hot liquid pattern material 240 flows around the pins 200 and 212 to almost completely enclose the core pattern assembly 162. Only the free end portions 216 of the pins 212 project from the wax article pattern material 240 into recesses formed in the die 222.

The molten wax article pattern material 240 solidifies in the die 222 to form a wax article pattern 244 (FIG. 8). The wax article pattern 244 has a configuration corresponding to the configuration of the cast metal article 20*a* of FIG. 6. The core pattern assembly 162 is enclosed by the wax article pattern 244. However, it should be understood that the core pattern assembly 162 is not a core. The core pattern assembly 162 merely has a configuration corresponding to the configuration of a core which is to be formed.

The wax article pattern 244 may be formed of either a natural wax or an artificial substance having some characteristics which are generally similar to the characteristics of natural waxes. Thus, the wax article pattern 244 may be formed of styrofoam or other injection moldable materials. As used herein, a wax may be either a natural or synthetic wax or a synthetic substance having some characteristics which are generally similar to the characteristics of a natural or synthetic wax.

The main core pattern member 166 and secondary core pattern members 174–192 are formed of a material which is compatible with the wax article pattern material 240 and can be readily removed from the article pattern material. Thus, if the article pattern material 240 is a natural or artificial wax, the main core pattern member 166 and secondary core pattern members 174–192 would be formed of a material which is dissolvable in a solution which does not effect the wax article pattern material 240. Thus, the main core pattern member 166 and secondary core pattern members 174–192 may be formed of polyethylene glycol which is water soluble. Alternatively, the main core pattern member 166 and secondary core pattern members 174–192 may be formed of a urea based composition. Therefore, the main core pattern member 166 and secondary core pattern members 174–192 can be leached from the article pattern 244 without effecting the material of the article pattern.

Once the wax article pattern 244 has been formed by injecting a suitable wax into the die 222, the wax article pattern is removed from the die with the core pattern assembly 162 enclosed in the wax article pattern. The material forming the main core pattern member 166 and secondary core pattern members 174–192 is then removed from the article pattern 244 (FIG. 8). Removal of the main core pattern member 166 (FIG. 7) from the article pattern 244 results in the formation of a main cavity 250 (FIG. 9) in the article pattern 244. Similarly, removal of the secondary core pattern members 174–192 (FIG. 8) from the article pattern 144 results in the formation of secondary cavities 254–272 (FIG. 9) having the same configuration as the secondary pattern members.

The pins 200 (FIG. 9) extend between the main cavity 250 and the secondary cavities 254–272. Thus, an end portion 204 of each of the parallel pins 200 is disposed in the main cavity 250. An end portion 206 of each of the pins 200 is disposed in one of the secondary cavities 254–272 in the article pattern 244. The number and configuration of the pins 200 corresponds to the number and configuration of the passages 100–118 (FIG. 6) in the cast metal article 20*a*.

The pins 212 (FIG. 9) extend from the secondary cavities 254–272 through flat parallel rectangular outer side surfaces 280 and 282 on the article pattern 244. The flat parallel outer side surfaces 280 and 282 of the article pattern 244 are interconnected by flat parallel rectangular end surfaces 286 and 288. The side surfaces 280 and 282 and end surfaces 286 and 288 on the article pattern 244 have a size and configuration which corresponds to the size and configuration of the outer side surfaces 132 and 152 and the end surfaces 154 and 156 (FIG. 6) on the cast metal article 20*a*.

Each of the parallel pins 212 (FIG. 9) has an end portion which is disposed in one of the secondary cavities 254–272 and a free end portion which projects outward from a side surface 280 or 282 of the article pattern 244. Thus, each of the pins 212 has end portion 214 which is disposed in the secondary cavity 254 and an end portion 216 which projects outward from the side surface 280 of the article pattern 244. A central portion of each of the pins 212 is enclosed by the article pattern 244 to support the pin. The portion of each of the pins 212 which is enclosed by the article pattern 244 has a size and configuration which corresponds to the size and configuration of the passages 120–128 and 138–146 (FIG. 6) formed in the cast metal article 20*a*.

Formation of a Core and Mold

The main cavity 250 and secondary cavities 254–272 (FIG. 9) in the article pattern 244 are utilized to mold a wet slurry of ceramic core material to a desired configuration. The cavities 250 and 254–272 in the wax article pattern 244 mold the wet slurry of ceramic core material the same manner as in which the cavity 34 (FIG. 3) in the wax article pattern 30 molds the wet slurry of ceramic core material 40 to a desired configuration in the embodiment of the invention illustrated in FIGS. 1–5. Thus, the main cavity 250 and the secondary cavities 254–272 in the article pattern 244 (FIG. 10) are filled with a wet slurry of ceramic core material.

If desired, the main cavity 250 may be filled with a ceramic core material 300 which is different from ceramic core material 302 (FIG. 10) which fills the secondary cavities 254–272. Thus, a ceramic core material 300 having a relatively coarse particle size is conducted into the main cavity 250 to retard distortion during firing of the core material. Ceramic core material 302 conducted into the secondary cavities 254–272 has a finer particle size distribution to increase the strength of cores formed in the secondary cavities 254–272. Of course, the main cavity 250 and secondary cavities 254–272 could be filled with identical slurries of ceramic core material.

A slurry of a ceramic core material 300 is conducted into the main cavity 250 to completely fill the main cavity. The slurry of the ceramic core material 300 in the main cavity 250 encloses end portions 204 of each of the pins 200. The wet slurry of ceramic core material 302 in the secondary cavities 254–272 encloses the opposite end portion 206 of each of the pins 200. Although only a single pin 200 has been illustrated in FIG. 10 as extending between the main cavity 250 and the secondary cavity 254, it should be understood that there are a plurality of pins 200 disposed in a linear array along the longitudinal axis of the secondary cavity 254 extending between the main cavity 250 and the secondary cavity 254. Therefore, the ceramic core material 302 in the secondary cavity 254 encloses end portions 206 of a plurality of pins 200.

Similarly, pins 200 extend between the core material 300 in the main cavity 250 and the core material 302 in each of the secondary cavities 256–272. In the embodiment of the invention illustrated in FIG. 10, the same relatively fine grain core material 302 is used in each of the secondary cavities 254–272. However, different core materials could be provided in at least some of the secondary cavities 254–272 if desired. As was previously mentioned, in the embodiment of the invention illustrated in FIG. 10, a relatively coarse grain ceramic core material 300 is cast in the main cavity 250 and a relatively fine grain ceramic core material 302 is cast in the secondary cavities 254–272.

Once the main cavity 250 and secondary cavities 254–272 have been filled with a wet slurry of ceramic core material, the ceramic core material is at least partially dried. The main cavity 250 (FIG. 10) in the article pattern 244 has a configuration which corresponds to the configuration of the main cavity 74 (FIG. 6) in the cast metal article 20*a*. The secondary cavities 254–272 (FIG. 10) have configurations corresponding to the configurations of the secondary cavities 76–94. Therefore, the main and secondary cavities 250 and 254–272 in the article pattern 244 will shape the slurry of core material filling the cavities to have a configuration corresponding to the configuration of the main cavity and secondary cavities 74–94 (FIG. 6) in the cast metal article 20*a*.

Once the core material 300 and 302 (FIG. 10) in the main cavity 250 and secondary cavities 254–272 has been at least partially dried and solidified, the article pattern 244 is enclosed with a wet covering 312 (FIG. 11) of ceramic mold material. The wet covering 312 of ceramic mold material has the same composition as the wet covering 52 (FIG. 4) of ceramic mold material in the embodiment of the invention illustrated in FIGS. 1–5. If desired, the ceramic core material 300 and 302 and the wet covering 312 of ceramic mold material could have the same composition.

The wet covering 312 (FIG. 11) of ceramic mold material completely encloses the article pattern 244. The wet covering 312 of ceramic mold material may be applied to the article pattern 244 by repetitively dipping the article pattern 244 in a slurry of ceramic mold material. The ceramic mold material encloses the end portions 216 of the pins 212 which project from opposite side surfaces 280 and 282 of the article pattern 244.

After the wet covering 312 of ceramic mold material has at least partially dried, the resulting mold 314 is heated to melt the wax material of the article pattern 244. The liquid melted wax of the article pattern 244 is poured out of the mold through an open pour cup.

Once the wax article pattern 244 has been melted and removed from the mold 314, a mold cavity 320 (FIG. 12) is formed in the mold 314. A main core member 324 is disposed in the mold cavity 320. Axially opposite end portions of the main core member 324 are connected with the mold 314 to support the main core member. Thus, axially opposite ends of the main core member 324 are enclosed by the ceramic mold material 312. The main core member 324 has a configuration which corresponds to the configuration of the main core pattern member 166 (FIG. 7) and the configuration of the main cavity 74 (FIG. 6) in the cast article 20*a*.

In addition, secondary core members 328, 330, 332, 334, 336, 338, 340, 342, 344 and 346 (FIG. 12) are disposed in the mold cavity 320. The secondary core members 328–346 have configurations which correspond to the configurations of the secondary core pattern members 174–192 of the core pattern assembly 162 (FIG. 7) and to the configurations of the secondary cavities 76–94 (FIG. 6) in the cast metal article 20*a*. The secondary core members 328–346 (FIG. 12) are supported by the pins 200 which extend between the main core member 324 and the secondary core members 328–346. In addition, the secondary core members 328–346 are supported by the pins 212 which extend between the secondary core members and the mold 314.

Figure 12:
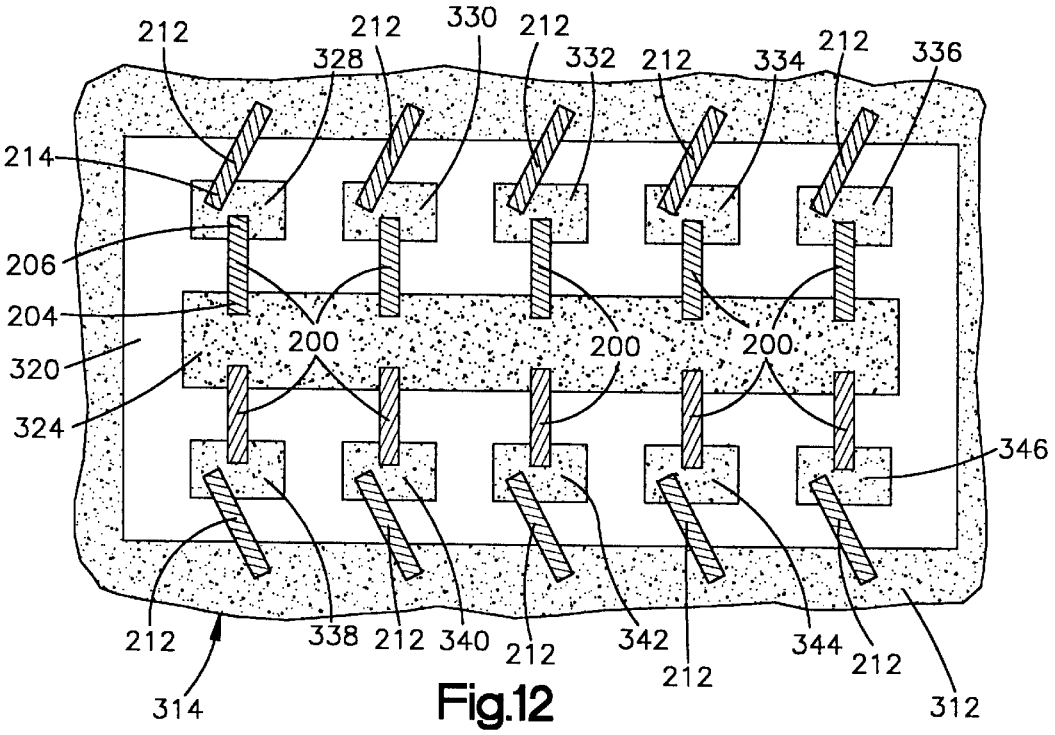
FIG. 12 is a schematic illustration depicting a mold cavity formed by removing the wax article pattern of FIG. 11.
Figure 13:
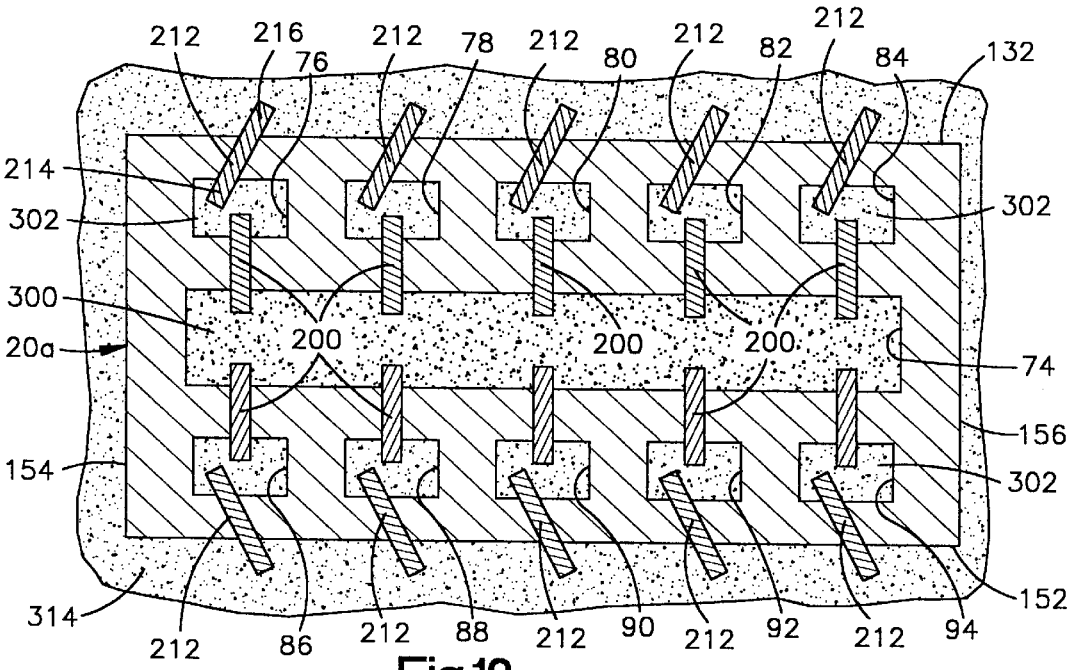
FIG. 13 is a schematic illustration depicting the manner in which a metal article is cast in the mold cavity of FIG. 12 by filling the mold cavity with molten metal.

The end portions 204 of each of the pins 200 are embedded in the main core member 324 (FIG. 12). The end portions 206 of each of the pins 200 are embedded in the ceramic core material of one of the secondary core members 328–346. The end portions 214 of the pins 212 are embedded in one of the secondary core members 328–346. The end portions 216 of the pins 212 are embedded in the ceramic mold material which forms the mold 314. It should be understood that although only a single pin 212 has been shown in FIG. 12 as having an end portion 214 embedded in the secondary core member 328, there are a plurality of pins having end portions 214 embedded in the secondary core member 328. Similarly, there are a plurality of pins 212 having end portions embedded in each of the secondary core members 330–346.

Once the wax article pattern 244 (FIG. 11) has been removed from the mold 314 to leave the article mold cavity 320 (FIG. 12), the mold is fired at a temperature of approximately 1,900° F. for a time sufficient to cure the mold and the core members. This results in the main core member 324 and the secondary core members 328–346 becoming rigid ceramic cores which are firmly held in place by the mold 314 and the pins 200 and 212.

Casting of Metal Article

Molten metal is then poured into the mold cavity 320 (FIG. 12) to fill the mold cavity. Molten metal surrounds the main core member 324 and the secondary core members 328–346. In addition, the molten metal surrounds the portions of the pins 200 which extend between the main core member 324 and the secondary core members 328–346. The molten metal also surrounds the portions of the pins 212 which extend between the secondary core members 328–346 and the mold 314.

The molten metal is then cooled in the mold cavity 320. Cooling the molten metal in the mold cavity 320 results in the formation of a cast metal article 20*a* (FIG. 13) having the same configuration as the cast metal article of FIG. 6. The cast metal article 20*a* is then removed from the mold 34.

The main core member 324 (FIG. 13) and secondary core members 328–346 are removed from the cast metal article 20*a* to leave the main cavity 74 and secondary cavities 76–94 in the cast metal article 20*a*. In addition, the pins 200 are removed from the cast metal article 20*a* to leave the passages 100–118 (FIG. 6) extending between the main cavity 74 and the secondary cavities 76–94. The pins 212 are removed to leave the passages 120–128 and 138–146 extending between the secondary cavities 76–94 and the outside of the cast metal article 20*a*.

The pins 200 and 212 are formed of a material which is capable of withstanding the relatively high temperatures of the molten metal to which the pins are exposed. The molten metal to which the pins 200 and 212 are exposed is a nickel-chrome superalloy. Therefore, the pins 200 and 212 are formed of alumina ($Al_2O_3$). Of course, the pins 200 and 212 could be formed of other materials, such as quartz, if desired.

Figure 10:
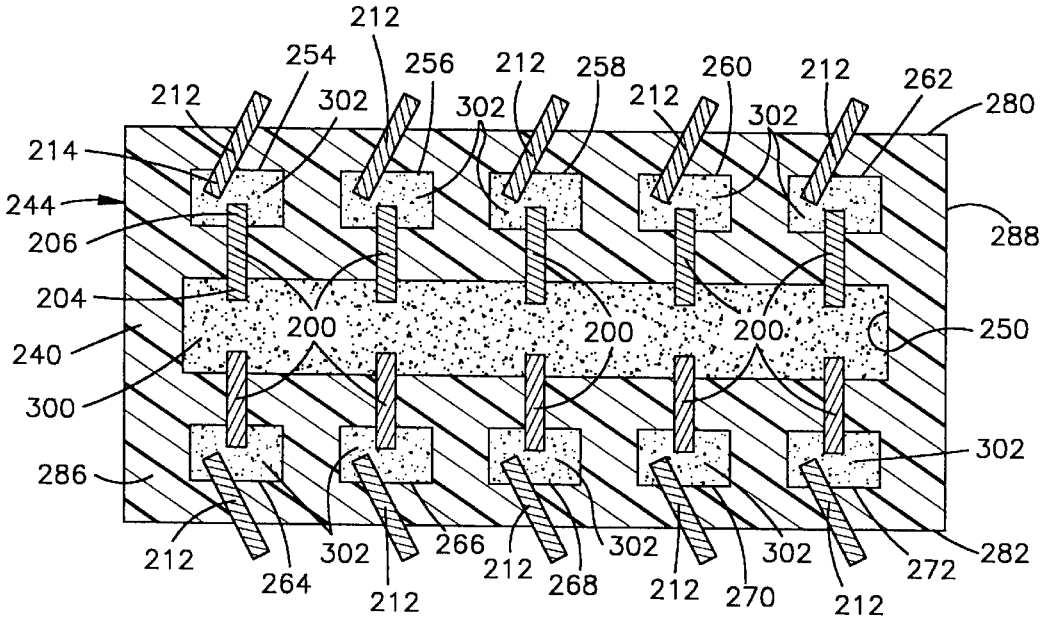
FIG. 10 is a schematic illustration depicting the manner in which the cavities in the wax article pattern are filled with ceramic core material.
Figure 11:
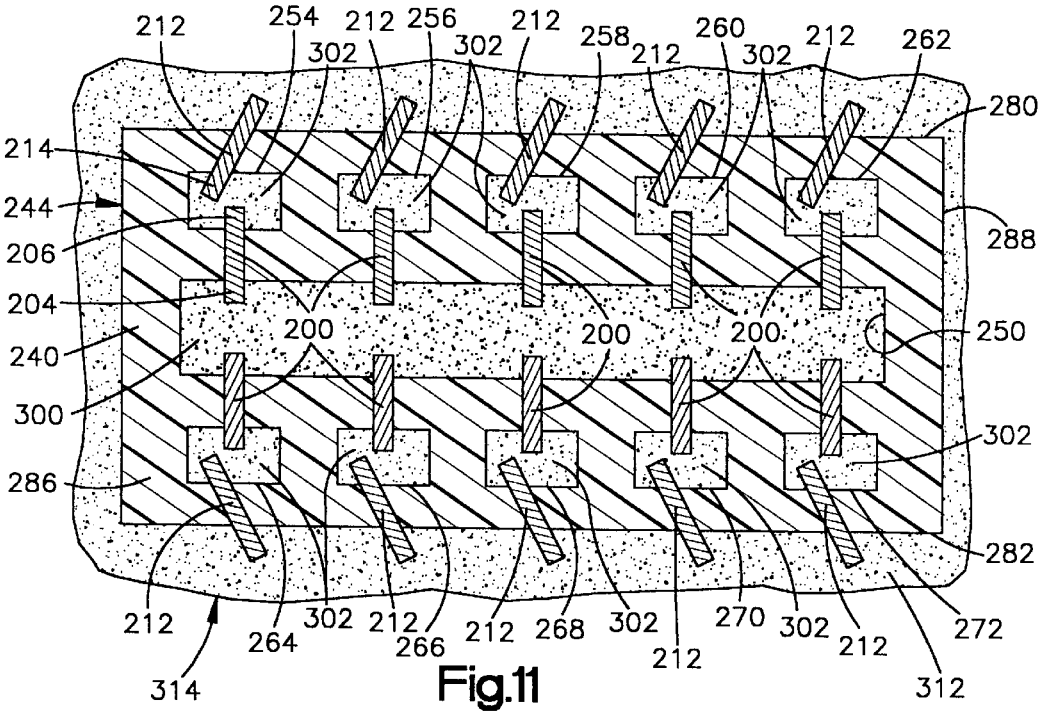
FIG. 11 is a schematic illustration depicting the manner in which the wax article pattern is enclosed by ceramic mold material after the cavities in the wax article pattern have been filled with ceramic core material.

In view of the foregoing description, it is apparent that present invention provides a new and improved method of casting a metal article 20*a* (FIG. 6) having cavities 74–94 and passages 100–128 and 138–146 formed therein. To form the cavities 74–94 in the metal article 20*a,* a wax article pattern 244 (FIG. 9) having a configuration corresponding to the configuration of the metal article 20*a* is formed. Wet slurries of ceramic core materials 300 and 302 are conducted into the cavities 74–94 in the wax article pattern to at least partially fill the cavities (FIG. 10). The outer side of the wax article pattern is at least partially enclosed with ceramic mold material 312 (FIG. 11). The ceramic core materials 300 and 302 are solidified to form cores 324 and 328–346 in the cavities in the wax article pattern 244. The ceramic mold material 312 is solidified to form a mold 314 which at least partially encloses the wax article pattern.

The wax article pattern 244 is then removed to leave an article mold cavity 320 (FIG. 12). Molten metal is conducted into the article mold cavity 312 and is solidified to form the metal article 20*a*. The cavities 74–94 (FIG. 6) in the metal article 200 are at least partially defined by the ceramic cores 324 and 328–346 (FIG. 12) and the outer side of the metal article 20*a* is at least partially defined by the ceramic mold 314.

Passages 100–146 (FIG. 6) are provided in the cast article 20*a*. Pins 200 and 212 are provided in association with the wax article pattern 240 (FIG. 9) to form the passages 100–146. A portion of each of the pins 200 and 212 is enclosed by the wax article pattern 240. Other portions 204, 206 and 214 of the pins 200 and 212 project into the cavities 250 and 254–272 (FIG. 9) in the wax article pattern 144.

When ceramic core materials 300 and 302 (FIG. 10) are conducted into the cavities 250 and 254–272 in the wax article pattern 244, the core materials 300 and 302 enclose the portions of the pins 200 and 212 which are disposed in the cavities. When the core materials 300 and 302 are solidified to form cores, a portion of each of the pins 200 and 212 is held by at least one of the cores. When the wax article pattern 244 is removed to leave an article mold cavity 320 (FIG. 12), a portion of each of the pins 200 and 212 is disposed in the article mold cavity. Therefore, when molten metal is conducted in to the article mold cavity 320 (FIG. 13), the molten metal encloses the portions of the pins 200 and 212 in the article mold cavity. Subsequent removal of the pins 200 and 212 from the cast metal article 20*a* results in the formation of passages 100–146 (FIG. 6) in the metal article 20*a*.

Third Embodiment

In the embodiment of the invention illustrated in FIGS. 7–13, the core pattern assembly 162 (FIG. 7) is used to form cavities 250 and 254–272 (FIG. 9) in a wax article pattern 244. However, it is contemplated that the article pattern 244 could be assembled without using a core pattern assembly corresponding to the core pattern assembly 162 of FIG. 7.

Figure 14:
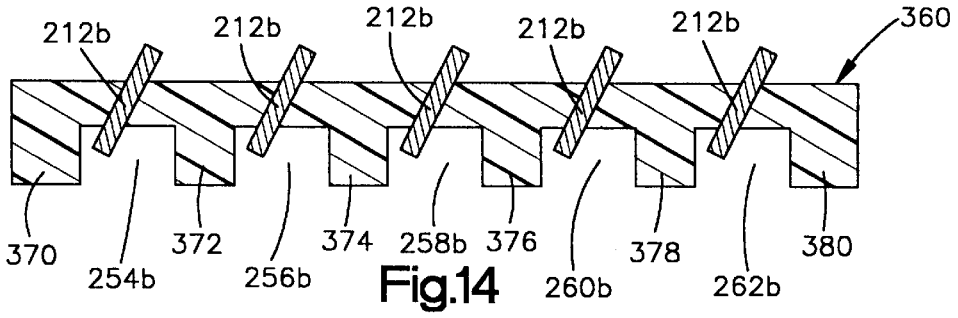
FIG. 14 is a schematic illustration of a first side component of a second embodiment of the wax article pattern of FIG. 9.
Figure 15:
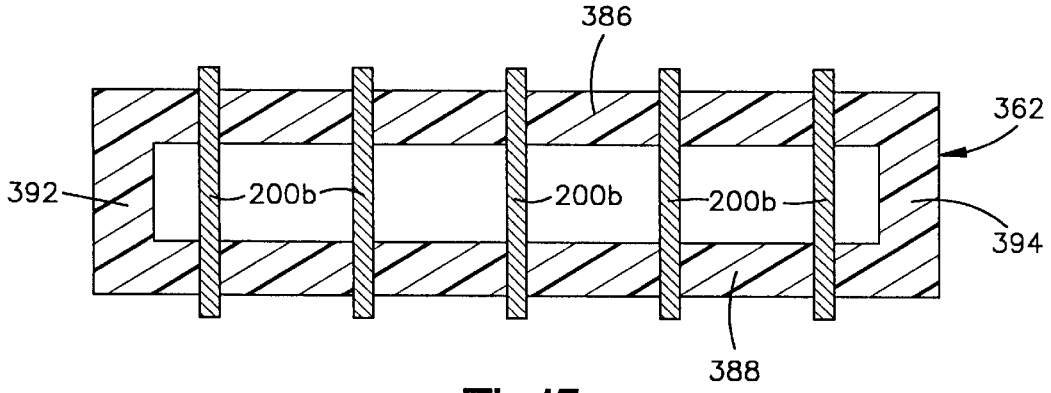
FIG. 15 is a schematic illustration of a center component of the second embodiment of the wax article pattern.
Figure 16:
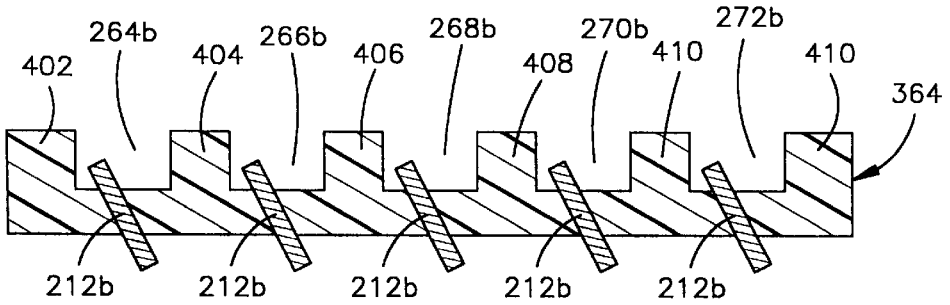
FIG. 16 is a schematic illustration of a second side component of the second embodiment of the wax article pattern.

In the embodiment of the invention illustrated in FIGS. 14–16, the article pattern is assembled from three separate components. Since the embodiment of the invention illustrated in FIGS. 14–16 is generally similar to the embodiment of the invention illustrated in FIGS. 7–13, similar numerals will be utilized to designate similar components, the suffix letter "b" being associated with the numerals of FIGS. 14, 15 and 16 to avoid confusion.

Figure 9:
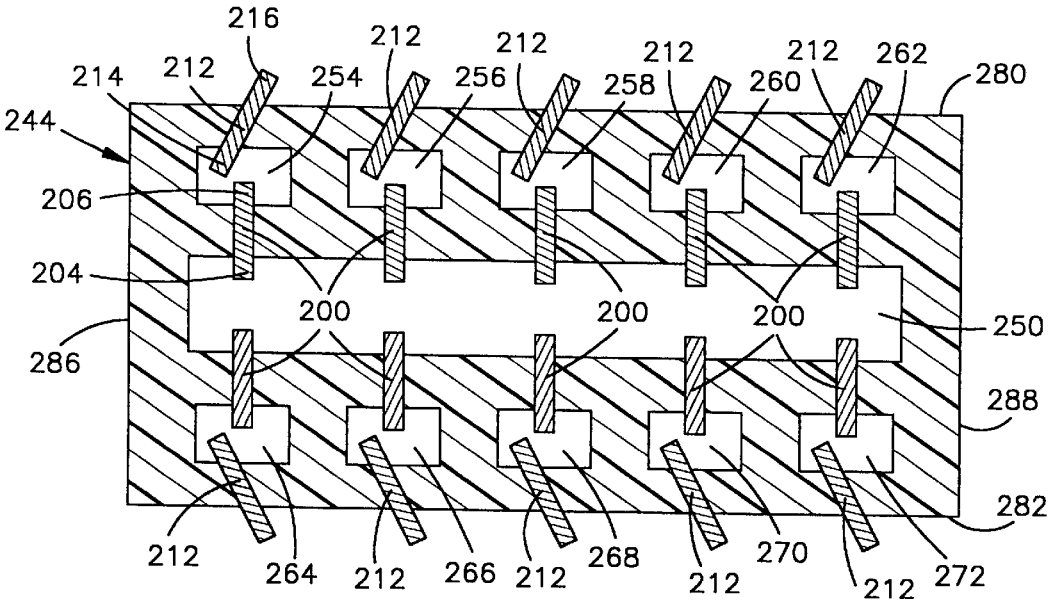
FIG. 9 is a schematic illustration of the wax article pattern of FIG. 8 after the members of the pattern assembly for making a core have been removed to leave cavities having a configuration corresponding to the configuration of the cavities in the metal article of FIG. 6.

In the embodiment of the invention illustrated in FIGS. 14–16, an article pattern having the same construction as the article pattern 244 of FIG. 9 is formed from three separate components. Thus, an article pattern is formed from a first side component 360 (FIG. 14), a center component 362 (FIG. 15) and a second side component 364 (FIG. 16). The first and second side components 360 and 364 are fixedly connected with the center component 362 to form the article pattern.

The first side component 360 is formed of a wax pattern material and has a main section 368 from which a plurality of rib sections 370, 372, 374, 376, 378, and 380 extend. The rib section 370–380 cooperate with the main section 368 to partially form the secondary cavities 254*b*, 256*b*, 258*b*, 260*b*, and 262*b*. Pins 212*b* extend through the main section 368 of the first side component 360.

The center component 362 (FIG. 15) has parallel main side walls 386 and 388 which are interconnected by end walls 392 and 394. The main walls 386 and 388 and the end walls 392 and 394 cooperate to form a main cavity 250 in the center component 362. Although the center component 362 may be formed of a single piece of wax pattern material, it is contemplated that the center component 362 could be formed of a pair of members which are interconnected to form the center component.

In the embodiment of the invention illustrated in FIG. 15, the pins 200*b* are long enough to extend through both of the main side walls 386 and 388 and the main cavity 250*b*. However, the pins 200*b* could be long enough so as to extend through only one of the main walls 386 or 388 if desired.

The second side component 364 has a construction which is similar to the construction of the first side component 360. Thus, the second side component 364 has a main section 400 and a plurality of secondary or rib sections 402, 404, 406, 408, 410, and 412 which extend from the main section 400. The rib sections 402–412 cooperate with the main section 400 to partially form secondary cavities 264*b*, 266*b*, 268*b*, 270*b*, and 272*b*.

The rib or secondary sections 370–380 of the first side component 360 are fixedly connected with the main side wall 386 of center component 362. This completes the formation of the cavities 254*b*–262*b*. Similarly, the rib or secondary sections 402–412 of the second side component are fixedly connected with the main side wall 388 of the center component 362. This completes the formation of the cavities 264*b*–272*b*. Connecting the two side components 360 and 264 with the center component 362 results in the formation of an article pattern having a configuration which corresponds to the configuration of the article pattern 244 of FIG. 9.

From the above description of the invention, those skilled in the art will perceive improvements, changes and modifications. Such improvements, changes and modifications within the skill of the art are intended to be covered by the appended claims.

Having described the invention, the following is claimed:

1. A method of casting a metal article having a cavity formed therein and an outer side, said method comprising the steps of providing an article pattern which has a cavity with a configuration which corresponds to the configuration of the cavity in the metal article and an outer side which has a configuration which corresponds to the configuration of the outer side of the metal article, at least partially filling the cavity in the article pattern with ceramic core material, at least partially enclosing the outer side of the article pattern with ceramic mold material, removing the article pattern to leave an article mold cavity which is partially defined by the ceramic core material and is partially defined by the ceramic mold material, at least partially filling the article mold cavity with molten metal, and solidifying the molten metal in the article mold cavity to form the metal article with the cavity in the metal article at least partially shaped by engagement of the molten metal with the ceramic core material and with the outer side of the metal article at least partially shaped by engagement of the molten metal with the ceramic mold material.

2. A method as set forth in claim 1 wherein said step of at least partially filling the cavity in the article pattern with ceramic core material includes at least partially filling the cavity in the article pattern with a slurry of ceramic core material, said method further including the step of at least partially drying the slurry of ceramic core material in the cavity in the article pattern before performing said step of removing the article pattern.

3. A method as set forth in claim 2 wherein said step of at least partially enclosing the outer side of the article pattern with ceramic mold material includes at least partially enclosing the outer side of the article pattern with a slurry of ceramic mold material after having performed said step of at least partially filling the cavity in the article pattern with a slurry of ceramic core material.

4. A method as set forth in claim 2 wherein said step of providing an article pattern includes providing an article pattern having a pin formed of a material which is different than material forming the article pattern, said pin extends into the cavity in the article pattern, said step of at least partially filling the cavity in the article pattern with a slurry of ceramic core material includes enclosing a portion of the pin with the slurry of ceramic core material, said step of at least partially drying the slurry of ceramic core material includes at least partially drying the ceramic core material with the ceramic core material in engagement with the pin.

5. A method as set forth in claim 1 wherein said step of removing the article pattern includes changing the article pattern from a solid condition to a flowable condition and inducing a flow of the material of the article pattern away from the ceramic core material.

6. A method as set forth in claim 1 wherein said step of providing an article pattern includes providing a core pattern having a configuration which corresponds to the configuration of at least a portion of the cavity in the metal article, at least partially enclosing the core pattern with flowable article pattern material, solidifying the article pattern material to form the article pattern, and removing the core pattern from the article pattern to form the cavity in the article pattern.

7. A method of casting a metal article having a cavity and a passage extending from the cavity into the metal article, said method comprising the steps of providing an article pattern having a cavity and a pin having a first portion which is disposed in the article pattern and a second portion which extends into the cavity in the article pattern, enclosing the second portion of the pin disposed in the cavity in the article pattern with wet ceramic core material, at least partially enclosing an outer side of the pattern with a wet ceramic mold material, drying the ceramic core material in the article pattern cavity to form a core which encloses the second portion of the pin, drying the ceramic mold material to form a mold, removing the article pattern from the mold to leave an article mold cavity with the first portion of the pin disposed in the article mold cavity, at least partially filling the article mold cavity with molten metal to form the metal article, said step of at least partially filling the article mold cavity with molten metal includes enclosing the first portion of the pin disposed in the article mold cavity with molten metal, and solidifying the molten metal in the article mold cavity to form the metal article in the article mold cavity with the core at least partially defining the cavity in the metal article and the first portion of the pin at least partially defining the passage in the metal article.

8. A method as set forth in claim 7 wherein said step of providing an article pattern having a cavity and a pin having a first portion which is disposed in the article pattern and a second portion which extends into the cavity in the article pattern includes providing a pin having a third portion which extends outward form an outer side of the pattern, said step of at least partially enclosing the outer side of the pattern with wet ceramic mold material includes at least partially enclosing the third portion of the pin with the wet ceramic mold material, said step of drying the ceramic mold material to form a mold includes forming a mold which encloses the third portion of the pin.

9. A method as set forth in claim 8 wherein said step of enclosing the second portion of the pin disposed in the cavity in the article pattern with wet ceramic core material includes at least partially filling the cavity in the article pattern with wet ceramic core material and shaping the wet ceramic core material to a desired configuration against an inner side of the cavity in the article pattern.

10. A method comprising the steps of providing a wax pattern of an article, flowing core material into a cavity in the wax pattern, shaping the core material to a desired configuration against an inner side of the cavity in wax pattern, solidifying the core material in the cavity in the wax pattern to form a core, covering an outer side of the wax pattern with mold material to form a mold which at least partially encloses the wax pattern, thereafter, removing the wax pattern from the mold to leave an article mold cavity in which an article is to be cast, conducting a flow of molten metal into the article mold cavity, and solidifying the molten metal in the article mold cavity.

11. A method as set forth in claim 10 wherein said step of solidifying the core material in the cavity in the wax pattern includes solidifying the core material around an outer side of a first portion of a pin which extends into the cavity in the wax pattern, said step of solidifying molten metal in the article mold cavity includes solidifying the molten metal around an outer side of a second portion of the pin.

12. A method as set forth in claim 11 wherein said step of covering an outer side of the wax pattern with mold material includes engaging a third portion of the pin with the mold material.

13. A method of forming a metal article having a plurality of cavities and passages extending between the cavities, said method comprising the steps of providing an article pattern having a plurality of cavities and a plurality of pins extending between cavities of the plurality of cavities, each pin of the plurality of pins having a first portion which is enclosed by the article pattern, a second portion which is disposed in a first one of the cavities of the plurality of cavities in the article pattern and a third portion which is disposed in a second one of the cavities of the plurality of cavities in the article pattern, conducting a flow of core material into each of the cavities in the article pattern, said step of conducting a flow of core material into each of the cavities in the article pattern includes shaping the core material to a desired configuration against surfaces of the cavities and enclosing portions of pins in at least some of the cavities in the article pattern with core material, solidifying the core material in the plurality of cavities to form a plurality of core sections, enclosing the article pattern with mold material to form a mold which at least partially encloses the core sections, removing the article pattern from the mold to leave an article mold cavity, conducting a flow of molten metal into the article mold cavity, said step of conducting a flow of molten metal into the article mold cavity includes enclosing portions of the pins with molten metal, solidifying the molten metal in the article mold cavity to form a metal article, removing the core sections from the metal article to leave cavities in the metal article, and removing the pins from the metal article to leave passages extending between the cavities in the metal article.

14. A method as set forth in claim 13 wherein the second end portions of at least some of the pins are disposed in the same one of the cavities in the plurality of cavities in the article pattern and the third end portions of at least some of the pins are disposed in spaced apart cavities in the article pattern, said step of removing pins from the metal article to leave passages extending between cavities in the metal article includes leaving a plurality of passages which extend from one of the cavities in the metal article to a plurality of spaced apart cavities in the metal article.

15. A method as set forth in claim 13 wherein said step of conducting a flow of core material into each of the cavities in the article pattern includes conducting a flow of a first core material into a first one of the cavities in the article pattern and conducting a flow of a second core material into a second one of the cavities in the article pattern.

16. A method as set forth in claim 13 wherein said step of providing an article pattern having a plurality of pins extending between cavities of the plurality of cavities includes providing a core pattern assembly which includes a plurality of spaced apart core pattern members with configurations corresponding to configurations of cavities in the metal article and a plurality of pins extending between the spaced apart core pattern members, conducting a flow of pattern material around the core pattern members and the pins to at least partially enclose the core pattern members and the pins with pattern material, solidifying the pattern material to form the article pattern with the core pattern members and pins at least partially enclosed by the article pattern, and removing the core pattern members from the article pattern to leave cavities in the article pattern.

* * * * *